US006689025B2

(12) United States Patent
Emick

(10) Patent No.: US 6,689,025 B2
(45) Date of Patent: Feb. 10, 2004

(54) EXERCISE DEVICE UTILIZING RUBBER TUBING

(76) Inventor: Daniel W. Emick, Rear 514, Weldon St., Montoursville, PA (US) 17754

( * ) Notice: Subject to any disclaimer, the term of this patent is extended or adjusted under 35 U.S.C. 154(b) by 0 days.

(21) Appl. No.: 10/170,474

(22) Filed: Jun. 13, 2002

(65) Prior Publication Data

US 2003/0232706 A1 Dec. 18, 2003

(51) Int. Cl.[7] ..... A63B 21/00
(52) U.S. Cl. ..... 482/123; 482/907; 482/121
(58) Field of Search ..... 482/131, 133, 482/907

(56) References Cited

U.S. PATENT DOCUMENTS 5,026,049 A * 6/1991 Goodman 5,147,266 A * 9/1992 Ricard

* cited by examiner

*Primary Examiner*—Jerome W. Donnelly
(74) *Attorney, Agent, or Firm*—Thomas R. Shaffer, Esq.

(57) ABSTRACT

The present invention discloses an exercise device which has a base, a vertical upright member attached to the base and at least one roller attached to the vertical upright member. A ratcheting hand crank is mounted to the upright member at a location spaced away from the roller. One or more lengths of exercise tubing are attached to the hand crank and extend at least partially around the roller. A second end of the length of exercise tubing which extends away from the roller is utilized by the user for resistance training. The amount of resistance can be adjusted by altering the available length of the exercise tubing with the hand crank.

21 Claims, 6 Drawing Sheets

EXERCISE DEVICE UTILIZING RUBBER TUBING

BACKGROUND OF THE INVENTION

1. Field of the Invention

The present invention relates to an exercise device. More particularly, it relates to an exercise device which utilizes rubber exercise tubing for resistance training.

2. Prior Art

A variety of exercise devices have been proposed and are in use today for the exercise of virtually every muscle of the human body. Many "universal" machines have been proposed for providing a full range of exercises. Popular home devices are sold under the trade names "Bowflex" with uses elongated rods for resistance and "Soloflex" which uses expensive weight straps for resistance.

It is also well known in the art to utilize elastic rubber exercise tubing for resistance training. Such product is a common, affordable and effective means of applying resistance to a muscle for improved strength, speed, power and rehabilitation. Round rubber exercise tubing may be utilized alone or in combination with an anchor strap or a hook on one end. A user attachment or a handle may be provided on the other end. Such round rubber exercise tubing provides for differing levels of resistance as the user moves closer or further away from the tubing anchor point. Because of this, often significant space is needed to achieve proper resistance. Resistance may also be changed by changing the tubing diameter. Such rubber exercise tubing is a common commercially available product.

Existing uses for such rubber exercise tubing have a number of drawbacks. The first drawback or problem relates to the need to find a suitable anchor point. Finding a safe anchor location in a convenient training area can often prove to be a challenge. Additionally, when a user finds such an anchor point, it seldom allows the user to make a vertical adjustment and thereby limits the user to certain exercise choices. Such anchor point also rarely provides a method of horizontal adjustment, again limiting exercise choice. Further, as stated above, the user must move away from the anchor point to increase the resistance which can prove to be a problem in an area of confined space or where there are crowded conditions.

One answer to the problem is to provide a permanent anchor point in the area where exercise is to take place. This may be a costly undertaking and thereafter limits the user to exercising in the same location. Also, portable units which can be affixed to a wall or a door are known such as, for example, commercially available units such as the "Lifeline OTW Gym 2000", "Lifeline Portable Gym" or the "S.O.S. Gym 4000". While these units do provide vertical adjustment capabilities for more exercise choice, they require the need for a wall, door or structure on which to mount such unit. These commercially available units must rely on the use of chairs and stools to accommodate popular leg extension, leg curl and rotator cuff exercises.

There remains a need for a portable, inexpensive exercise device which utilizes rubber exercise tubing for resistance training. There remains a need for such a portable device which can be easily collapsed for storage and which can provide not only vertical adjustment of an anchor point but also horizontal adjustment. There further remains a need for a device which can be utilized in a confined space which may or may not be near a door or wall.

SUMMARY OF THE INVENTION

The present invention provides an exercise device which in its simplest form includes a base, a vertical upright member attached to said base, at least one roller attached to said vertical upright member, a ratcheting hand crank mounted to said upright member at a location spaced from said at least one roller and at least one length of exercise tubing, said at least one length of exercise tubing having a first portion attached to said ratcheting hand crank, said at least one length of exercise tubing extending partially around said at least one roller and said at least one length of exercise tubing having a second end extending away from said roller whereby resistance is provided to a user who pulls upon said second end of said at least one length of exercise tubing and whereby the amount of resistance may be adjusted by altering an available length of said exercise tubing with said hand crank.

A preferred embodiment of the invention said at least one roller is attached to a first clamp member, said first clamp member is removably attached to said vertical upright member at one first clamp location selected from a plurality of vertical first clamp locations on said upright member and said first clamp member adapted for movement to any other of said plurality of vertical first clamp locations on said upright member.

Preferably, said at least one roller is a pair of rollers which extend outwardly from opposite sides of said first clamp member. Said pair of rollers are adapted for rotation in a common axis of rotation.

Preferably, said at least one length of exercise tubing comprises two lengths of exercise tubing with each length of exercise tubing extending partially around one of two rollers.

Preferably, each length of exercise tubing has a first portion comprising a first end.

Preferably, the ratcheting hand crank is attached to a second clamp member, said second clamp member removably attached to said vertical upright member at one second clamp location selected from a plurality of vertical second clamp locations on said upright member and said second clamp adapted for movement to any other of said plurality of vertical second clamp locations on said upright member. The second clamp member may have an identical structure to said first clamp member or may have a slightly modified structure as may be required to mount the ratcheting hand crank.

Preferably, the base of the present invention is generally rectangular and is comprised of a first plate member and a second plate member with said first plate member and said second plate member pivotally connected to one another whereby said base can be collapsed and folded with said first plate member and said second plate member positioned on top of one another when not in use and unfolded when in use with said first plate member and said second plate member each lying flat upon a floor or other generally flat surface. Preferably, the base has a upright support member adapted to removably receive and secure the vertical upright member when said device is in use and which allows said upright member to be removed for storage when said device is not in use.

Preferably, the present invention further comprises a removable seat member, said seat member having a seat portion with a first end thereof removably secured to said vertical upright member, said seat member also having at least one pivotally attached leg which pivots between a collapsed storage position and an open use position wherein said seat leg extends downwardly and is supported by said base member.

Preferably, the seat member is an elongated bench member which also allows the user to recline thereon. Still further, the bench member preferably has a fold down leg with a roller member mounted on each side thereof to facilitate hamstring and quadricep exercises.

The base member also preferably has at least one recess therein, each said recess containing a base roller to allow fro insertion of at least one length of exercise tubing at least partially around said base roller to permit exercises with at least one length of exercise tubing connected to the base.

Preferably, the vertical upright member is composed of a lower upright member which is removably attached to said base and an upper upright member which is removably attached to said lower upright member.

Preferably, said at least one roller is attached to said vertical upright member and is mounted for rotation on an axle which is transverse to said upright member.

Further, it is preferred that each of said at least one roller has a collar at opposite ends of such roller whereby said collars restrain transverse movement of said at least one length of exercise tubing.

In one alternative embodiment of the invention said at least one roller may be mounted for rotation on said axle at plural locations at varying distances from said vertical upright member.

In another alternative embodiment of the invention, each of said at least one roller has a plurality of collars thereon to allow said at least one length of exercise tubing to be restrained in any of plural desired transverse locations at varying distances from said vertical upright member.

Preferably, a grip handle is attached to said second end of said at least one exercise tubing.

Still further, it is preferred that the ratcheting hand crank includes attaching means to removably attach said at least one length of exercise tubing.

One form of the attaching means is a hook provided on said ratcheting hand crank.

An alternative attaching means is a hole provided through said ratcheting hand crank.

DETAILED DESCRIPTION OF THE PREFERRED EMBODIMENTS

Figure 1:
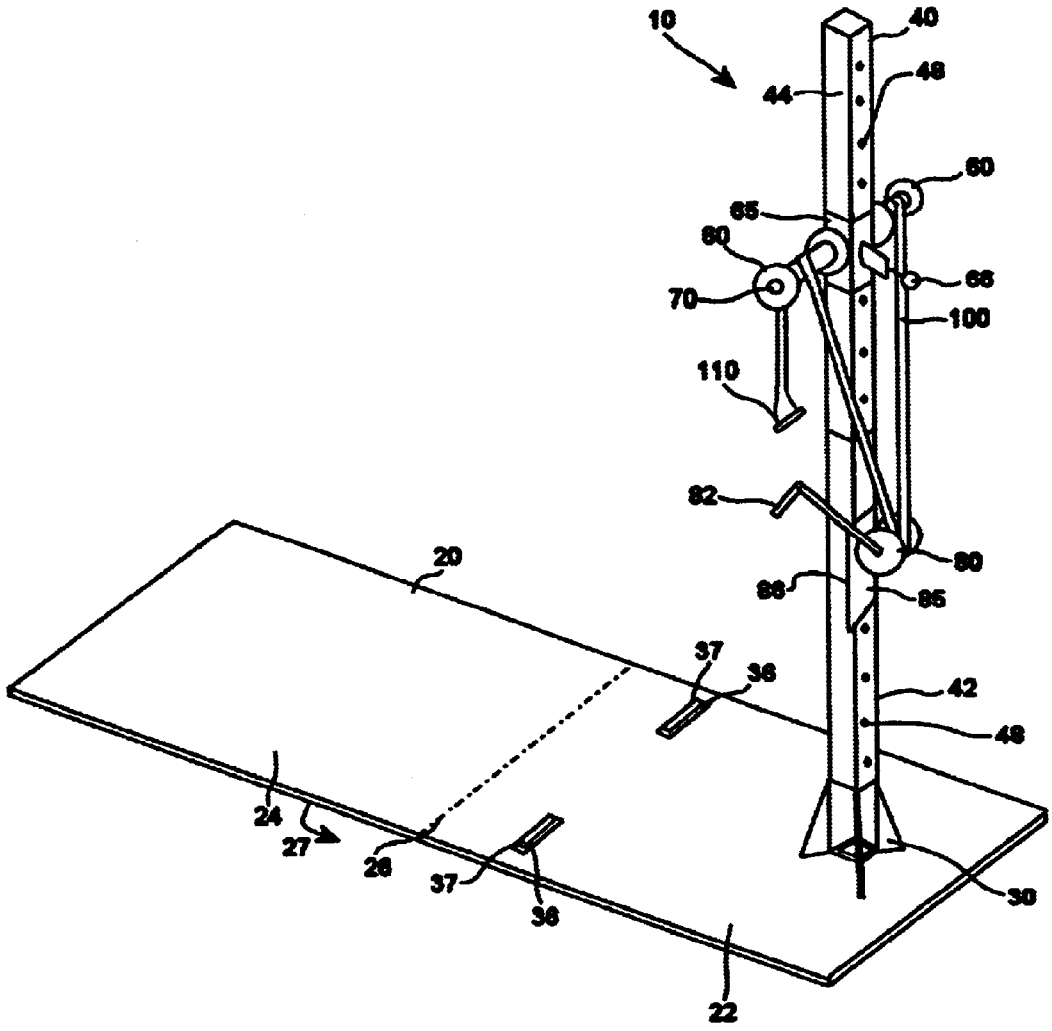
FIG. 1 is an isometric view of the presently preferred embodiment of the present invention.

Referring to FIG. 1, an exercise device 10 is provided. The exercise device 10 includes a base 20 which is generally rectangular in shape. Preferably, base 20 is formed from plate member 22 and plate member 24 which are pivotally attached at location 26. This allows plate portion 24 to rotate in the direction of arrow 27 with respect to base plate 22 allowing for the collapse and storage thereof. Base member 20 is preferably formed of a waffleboard plastic and is preferably approximately 1 inch thick. As shown in FIG. 1, a pair of recesses 36 are each provided with a roller 37 to allow space for an exercise tubing to pass through. As shown, base 20 also is provided with an upright support member 30 which is adapted to removably receive and secure a vertical upright member 40 when such device is in use and allows said upright member 40 to be removed from storage when said device is not in use.

The vertical upright member 40 is preferably formed of a lower portion 42 which is inserted into the upright support member 30 as shown. Upright member 40 also includes an upper portion 44 which is telescopically inserted into lower portion 42. A plurality of holes 48 are provided along the entire length of vertical upright member 40. A pair of rollers 60 are mounted on a first clamp member 65. First clamp member 65 is preferably a u-shaped clamp which slides upwardly and downwardly on upright member 40. A push pin 66 is utilized to secure the first clamp member 65 at a desired vertical location into a particular hole 48 which is at a desired vertical location. Clamp 65 includes a pair of fixed axles 70 which extend outwardly therefrom. Rollers 60 rotate relative to axles 70.

A ratcheting hand crank 80 which is attached to a second clamp member 85 is also provided. A push pin 86 is utilized to secure the second clamp member into an appropriate hole 48 at a desired vertical location on the vertical upright member 40.

A length of exercise tubing 100 has a first portion thereof attached to crank 80 and a second portion thereof extending around rollers 60. Preferably, a handle 110 is provided at a second end 106 of the at least one length of exercise tubing 100.

Figure 2:
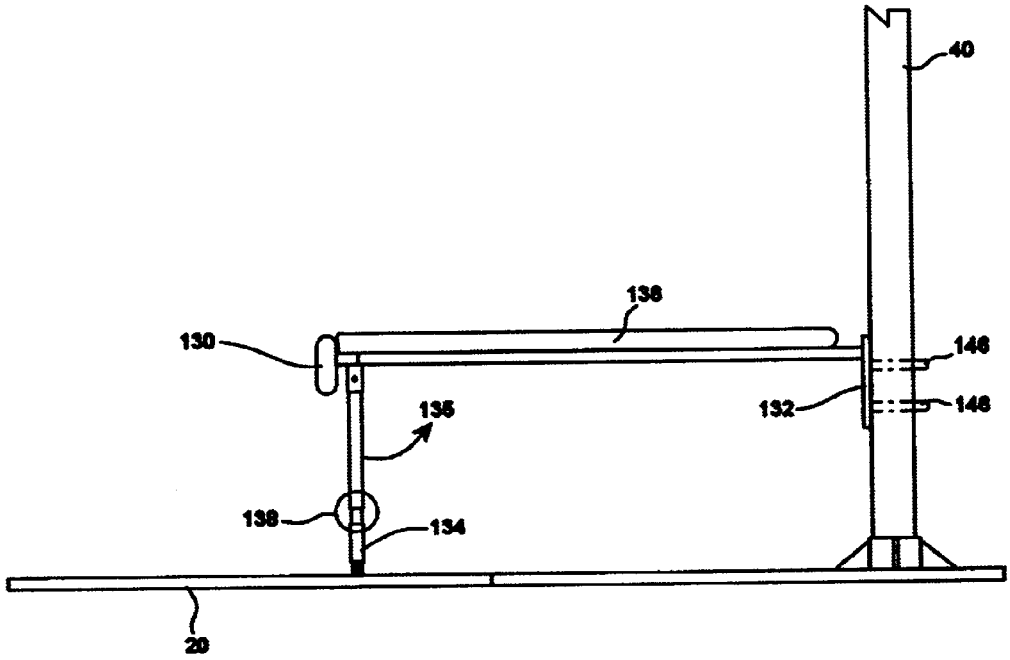
FIG. 2 is a side elevational view showing the seat member in the form of an elongated bench attached to the invention.

Referring to FIG. 2, a seat member 130 is provided. It has a seat portion 136 having a first end 132 secured to the vertical upright member 40. This is accomplished by push pins 146. The removable seat member 130 also has at least one pivotally attached leg 134 which pivots between a collapse storage position and an open use position wherein the seat leg 134 extends downwardly and is supported by said base member 20 as is shown in FIG. 2.

Figure 3:
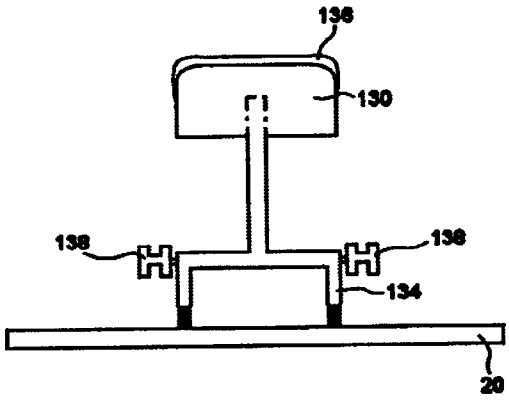
FIG. 3 is an end elevational view of the seat member.

FIG. 3 shows an end view of the removable seat member 130 of the present invention in its use position. As can best be seen in FIG. 3, preferably a pair of seat rollers 138 are provided on opposite sides of the seat leg 134 to facilitate hamstring and quadricep exercises.

Figure 4:
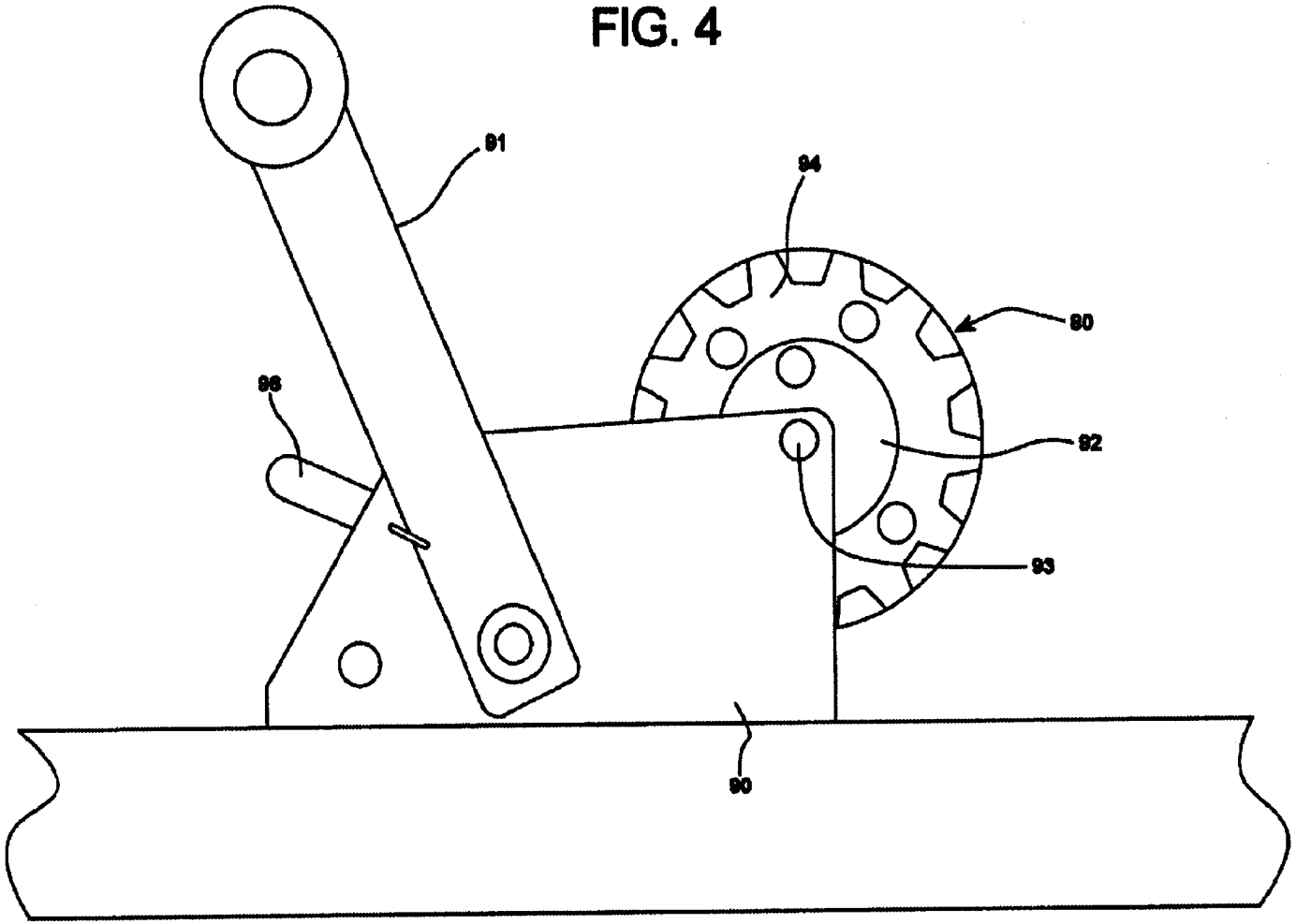
FIG. 4 is a side view of the ratcheting hand crank utilized with the present invention.
Figure 5:
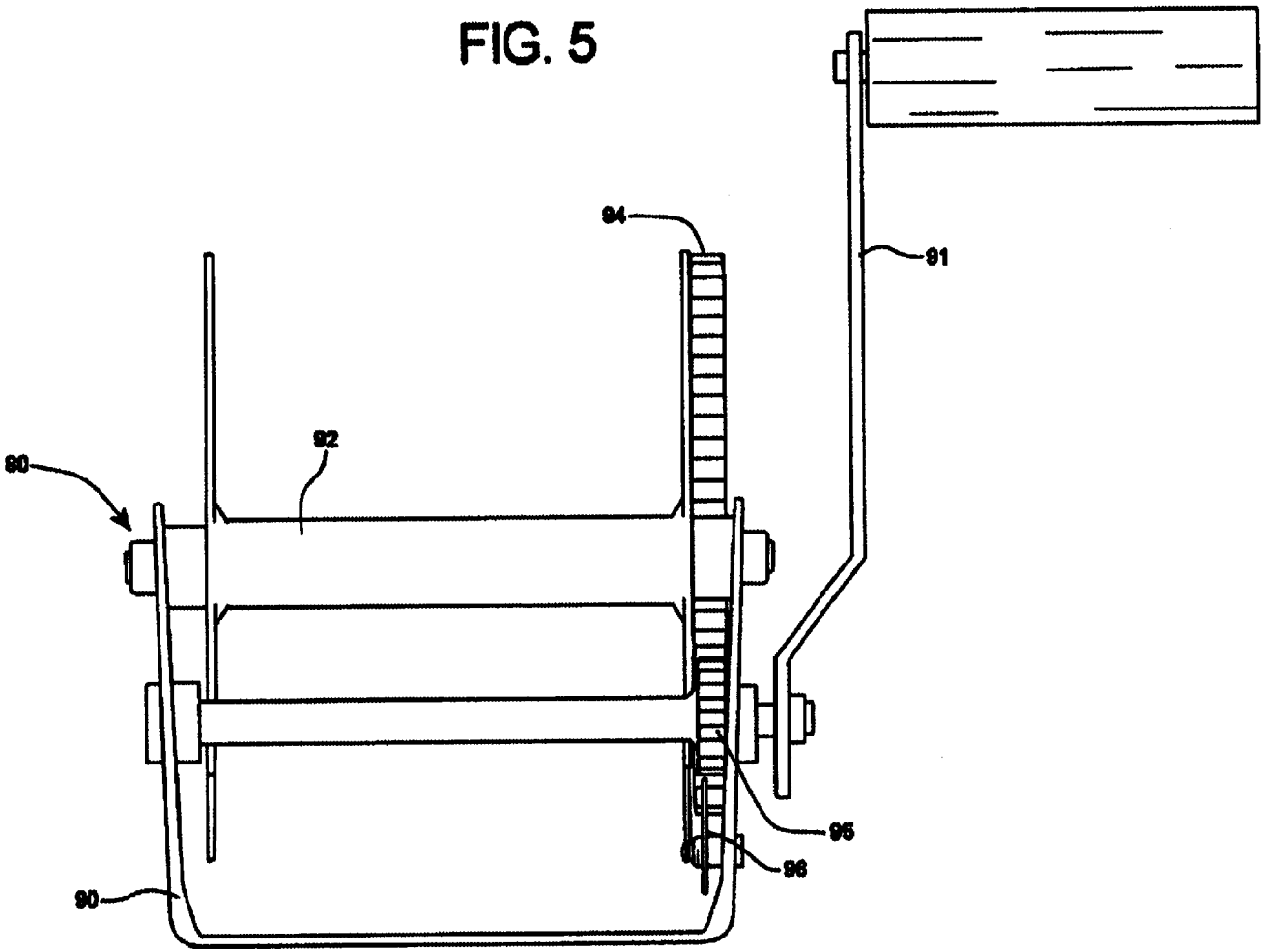
FIG. 5 is an end view of the hand crank of FIG. 4.

FIGS. 4 and 5 show the structure of hand crank 80 which is a commercially available unit such as the type sold under the name "Shelby—model 5403". The crank will turn in a first direction but will not be allowed to turn in the opposite direction until a release button is activated. The crank member 80 preferably includes pulley frame 90, crank arm and handle 91, a tubing spindle drum 92, tubing anchor hole 93, tubing spindle gear 94, crank lock gear 95, and crank lock gear release lever 96. The tubing may be secured to the spindle drum 92 by inserting either first end portions of two tube members or a middle portion of a single tube member into the tubing anchor hole 93.

Figure 6:
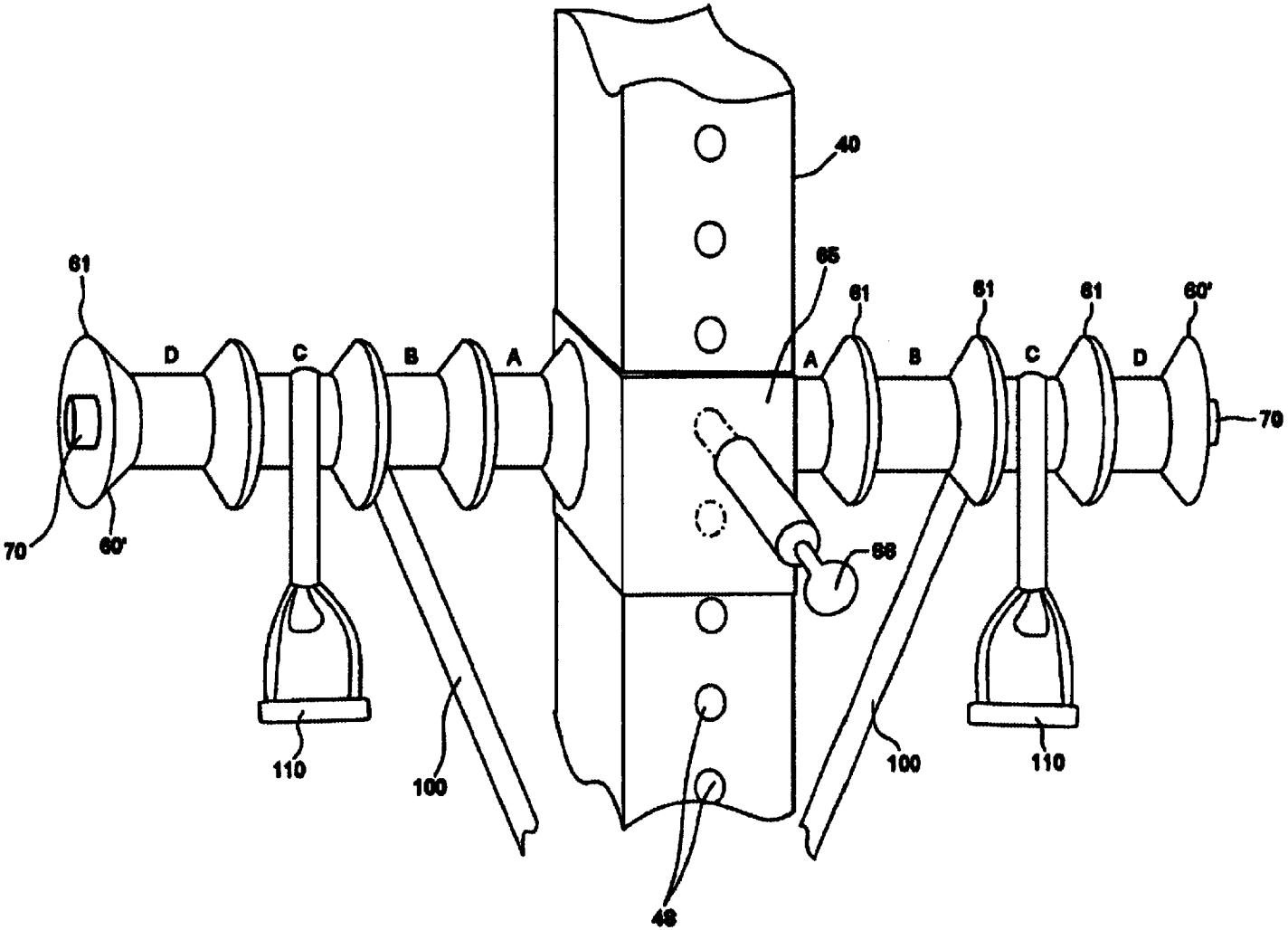
FIG. 6 is an isometric view of an alternative roller of the present invention.
Figure 7:
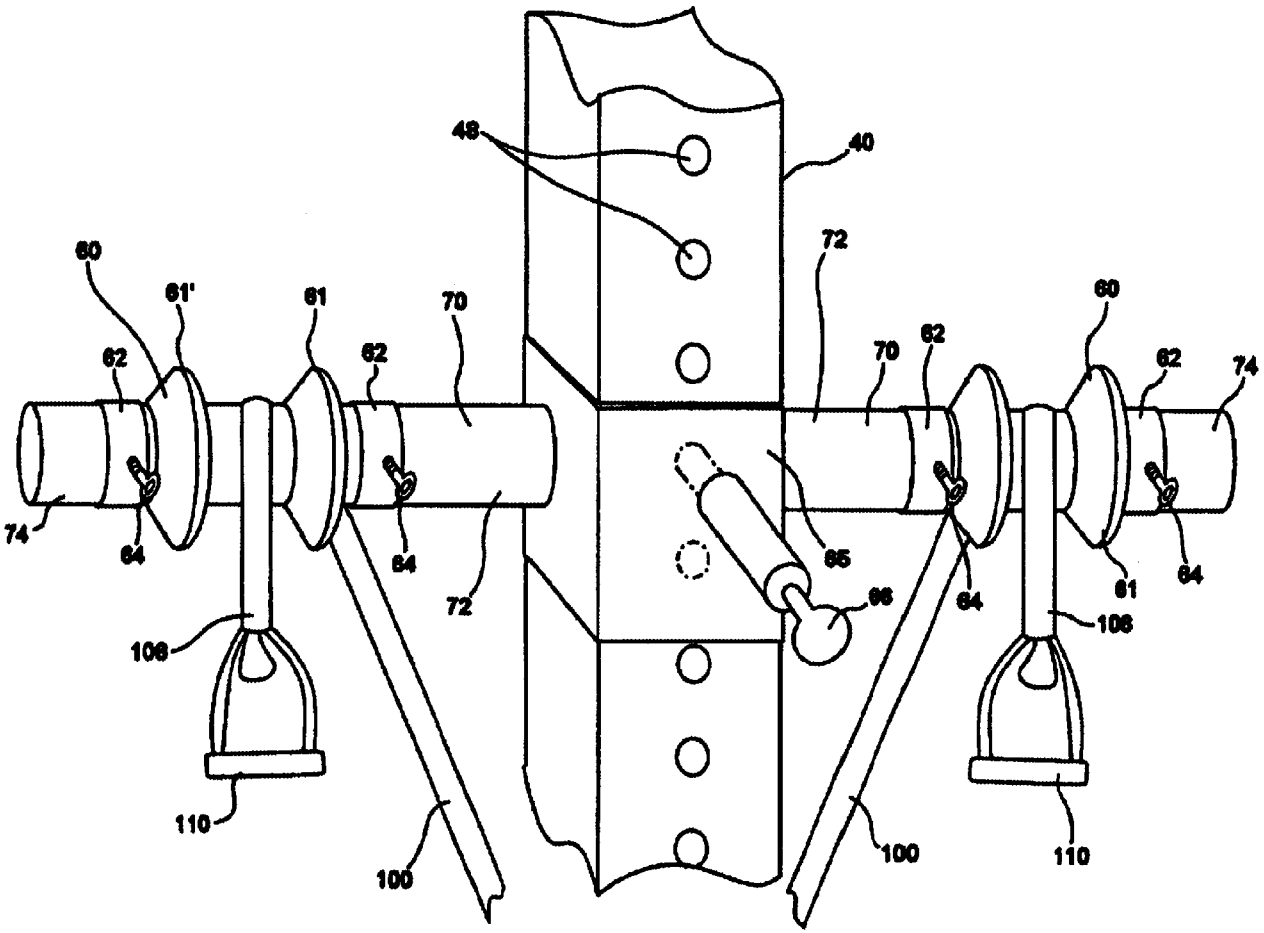
FIG. 7 is an isometric view of yet another alternative roller attachment means to allow for horizontal adjustment of the rollers of the present invention.

Referring to FIGS. 6 and 7, two alternative embodiments of the present invention are shown which allow for a horizontal adjustment of the location at which the exercise tubing 100 passes over the roller. First, referring to FIG. 6, a pair of rollers 60' are shown as mounted on axles 70 which extend transversely from opposite sides of mounting clamps 65. In this embodiment, a plurality of collars 61 are provided on each roller 60' so as to create a plurality of spaces, labeled A, B, C and D which are provided at different distances from the upright member 40. It will be obvious to the reader that this will allow the user to have the handles 110 either spaced relatively close together or at a desired distance apart.

FIG. 7 shows an alternative embodiment of providing the same type of horizontal adjustment shown in FIG. 6. In this 33 embodiment, however, rather than providing rollers 60' which have plural collars 61, in this instance, shorter rollers 60 are provided which have only a pair of collars 61 at each end thereof. A retaining ring 60 which is secured in place by screws 64 are utilized to provide the proper horizontal adjustment on axle 70.

It will be obvious that the entire invention may be collapsed to a very small size for storage. It will also be obvious that since the rubber exercise tubing is easily attached to the crank member, that said exercise tubing may be easily replaced with either the same or any desired diameter tubing to provide a greater range of resistance.

The invention having been disclosed in connection with the foregoing variations and examples, additional variations will now be apparent to those skilled in the art. The invention is not intended to be limited to the variations specifically mentioned, and accordingly, reference should be made to the appended claims rather than the foregoing discussion of preferred examples, to assess the scope of the invention in which exclusive rights are claimed.

I claim:

1. An exercise device comprising:

a) a base;

b) a vertical upright member attached to said base;

c) at least one roller attached to said vertical upright member;, d) a ratcheting hand crank mounted to said upright member at a location spaced from said at least one roller; and e) at least one length of elastic exercise tubing, said at least one length of exercise tubing having a first portion attached to said ratcheting hand crank, said at least one length of exercise tubing extending partially around said at least one roller and said at least one length of exercise tubing having a second end extending away from said roller whereby resistance is provided to a user who pulls upon said second end of said at least one length of exercise tubing and whereby the amount of resistance may be adjusted by altering an available length of said exercise tubing with said hand crank.

2. An exercise device according to claim 1 wherein said at least one roller is attached to a first clamp member, said first clamp member removably attached to said vertical upright member at one first clamp location selected from a plurality of vertical first clamp locations on said upright member and said first clamp adapted for movement to any other of said plurality of vertical first clamp locations on said upright member.

3. An exercise device according to claim 2 wherein said at least one roller is a pair of rollers which extend outwardly from opposite sides of said first clamp member, said pair of rollers adapted for rotation in a common axis of rotation.

4. An exercise device according to claim 3 wherein said at least one length of exercise tubing extending partially around said at least one roller comprises two lengths of exercise tubing each length of exercise tubing extending partially around one of said two rollers.

5. An exercise device according to claim 4 wherein each length of exercise tubing has a first portion comprising a first end.

6. An exercise device according to claim 1 wherein said ratcheting hand crank is attached to a second clamp member, said second clamp member removably attached to said vertical upright member at one second clamp location selected from a plurality of vertical second clamp locations on said upright member and said second clamp adapted for movement to any other of said plurality of vertical second clamp locations on said upright member.

7. An exercise device according to claim 1 wherein said base is generally rectangular is comprised of a first plate member and a second plate member with said first plate member and said second plate member pivotally connected to one another whereby said base can be collapsed and folded with said first plate member and said second plate member positioned on top of one another when not in use and unfolded when in use with said first plate member and said second plate member each lying flat upon a floor or other generally flat surface.

8. An exercise devise according to claim 1 wherein said base has a upright support member adapted to removable receive and secure said vertical upright member when said device is in use and which allows said upright member to be removed for storage when said device is not in use.

9. An exercise device according to claim 1 further comprising a removable seat member, said seat member having a seat portion with a first end thereof removably secured to said vertical upright member, said seat member also having at least one pivotally attached leg which pivots between a collapsed storage position and an open use position wherein said seat leg extends downwardly and is removably attached to said base member.

10. An exercise device according to claim 9 wherein said seat member is an elongated bench member which allows a user to recline thereon.

11. An exercise device according to claim 9 wherein said base member has a recess therein to receive and secure each said downwardly extended seat leg.

12. An exercise device according to claim 9 wherein said seat leg has a seat roller member mounted on each side thereof.

13. An exercise device according to claim 1 wherein said vertical upright member is composed of a lower upright member which is removably attached to said base and an upper upright member which is removably attached to said lower upright member.

14. An exercise device according to claim 1 wherein at least one roller attached to said vertical upright member is mounted for rotation on an axle which is transverse to said upright member.

15. An exercise devise according to claim 13 wherein each of said at least one roller has a collar at opposite ends of such roller whereby said collars restrain transverse movement of said at least one length of exercise tubing.

16. An exercise devise according to claim 14 wherein said at least one roller may be mounted for rotation on said axle at plural locations at varying distances from said vertical upright member.

17. An exercise devise according to claim 13 wherein each of said at least one roller has a plurality of collars to allow said at least one length of exercise tubing to be restrained in one of desired transverse locations at varying distances from said vertical upright member.

18. An exercise device according to claim 1 further comprising a grip handle attached to said second end of said at least one length of exercise tubing.

19. An exercise device according to claim 1 wherein said ratcheting hand crank includes attaching means to removably attach said at least one length of exercise tubing.

20. An exercise device according to claim 18 wherein said attaching means is a hook provided on said ratcheting hand crank.

21. An exercise device according to claim 18 wherein said attaching means is a hole provided through said ratcheting hand crank.

* * * * *

UNITED STATES PATENT AND TRADEMARK OFFICE

CERTIFICATE OF CORRECTION

PATENT NO. : 6,689,025 B2
DATED : February 10, 2004
INVENTOR(S) : Daniel W. Emick It is certified that error appears in the above-identified patent and that said Letters Patent is hereby corrected as shown below:

Column 5,
Line 11, delete “33” before “embodiment”

Signed and Sealed this

Twenty-ninth Day of June, 2004

JON W. DUDAS
*Acting Director of the United States Patent and Trademark Office*